US006302804B1

(12) United States Patent
Budde

(10) Patent No.: US 6,302,804 B1
(45) Date of Patent: Oct. 16, 2001

(54) GOLF PUTTER AND METHOD OF MANUFACTURING

(76) Inventor: Donald F. Budde, 1701 Old Eatherton Rd., Glencoe, MO (US) 63038

( * ) Notice: Subject to any disclaimer, the term of this patent is extended or adjusted under 35 U.S.C. 154(b) by 0 days.

(21) Appl. No.: 09/276,604

(22) Filed: Mar. 25, 1999

(51) Int. Cl.[7] ..... A63B 53/04; A63B 69/36; A63B 53/10; A63B 53/12

(52) U.S. Cl. ..... 473/251; 473/335; 473/340; 473/349; 473/316; 273/DIG. 8

(58) Field of Search ..... 473/324, 349, 473/350, 334, 335, 256, 291, 289, 290, 316, 251, 340; 273/DIG. 8

(56) References Cited

U.S. PATENT DOCUMENTS

D. 211,586 * 7/1968 Wozniak .
2,665,909 * 1/1954 Wilson .
3,661,388 * 5/1972 Leslie .
3,909,005 * 9/1975 Piszel .
4,082,277 * 4/1978 Van Auken .
4,361,329 * 11/1982 Brock .
4,422,638 12/1983 Tucker .
4,614,268 * 9/1986 Chlebina .
4,718,185 * 1/1988 Conlin .
4,754,976 * 7/1988 Pelz .
4,960,279 10/1990 Harris, Jr. .
5,078,398 1/1992 Reed et al. .
5,377,979 1/1995 Long .
5,516,107 * 5/1996 Okumoto .
5,542,675 8/1996 Micciche et al. .
5,690,879 * 11/1997 Lake .
5,782,706 7/1998 DePriest .
6,093,112 * 7/2000 Peters .
6,106,755 * 8/2000 Pfoertner .

OTHER PUBLICATIONS

Hornung's Pro Golf Sales, Inc. 1998–1999 Merchandise Catalog, cover page and p. 68.

* cited by examiner

*Primary Examiner*—Sebastiano Passaniti
(74) *Attorney, Agent, or Firm*—Polster Lieder Woodruff & LUcchesi, LC

(57) ABSTRACT

A golf putter constructed to appear to be completely constructed from an elastrometric material. The putter has a putter head molded from urethane material and constructed so that it appears to have to be constructed entirely of that material. The putter preferably is color coordinated so that the putter may match a desired motif.

12 Claims, 1 Drawing Sheet

GOLF PUTTER AND METHOD OF MANUFACTURING

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

This invention relates to golf putter construction and more particularly to a golf putter construction having simplified manufacturing techniques and improved playing characteristics.

Urethane and/or other putter face inserts presently are popular in golf putter construction designs because the insert gives improved feel to a player. A number of putter constructions have been designed to allow an insert to placed along the ball striking face of the putter. In addition, adapters constructed from urethane have been employed with conventional putter design, as described, for example in U.S. Pat. No. 5,542,675.

In addition, it is know to have color coordinated putter constructions. In the prior art designs with which I am familiar, the ball striking face of the putter is made up of metallic surface part and a plastic material surface part. The metallic part commonly is brass, and the remaining portion of the head is a plastic construction. Although the plastic part of the putter head can have various colors associated with it, the ball striking surface essentially is brass (or other metallic material), and the feel obtained from the urethane insert is missing.

While these prior art constructions work for their intended purpose, there still is a need for a putter head that gives the feel of a urethane insert but provides the ability to color coordinate the putter head for other purposes. I have devised a putter construction which permits relatively low cost, high volume production output. My construction has a number of advantages heretofore not available with the prior art. First, the putter head appears to be constructed entirely from elastrometric material, preferably urethane, and in particular, the ball striking surface is a urethane surface, and no metallic material comes into direct contact with the golf ball. Consequently, the putter exhibits excellent feel. In addition, because the ball-striking surface is all urethane, the surface can be form to provide improved over spin characteristics to golf balls.

While the entire putter head appears to be non-metallic, in fact, the putter head is designed so that the swing weight of the putter head is a combined weight of a mass of material encapsulated by the urethane and the weight of the urethane itself. For purposes of this specification, the shaft weight is not included in the determining the swing weight of the club. This method of construction has a number of other advantages. First, the putter swing weight is changed merely by adjusting the weight of the material mass within the urethane, so that the putter weight can be easily tailored to individual preferences. As indicated above, the development of a completely encapsulated putter design allows the putter manufacturer to utilized conventional urethane-molding techniques so that the putter can be constructed at relatively low cost and in mass quantities. In addition, the putter head design can be altered easily, merely by a simple mold redesign. Finally, because urethane is utilized, it is a simple matter to colored coordinated the putter, either with the shaft and/or with some other desired motif For example, in designing a putter for woman, the color of the shaft and head can be easily altered so that the putter design can match the golf bag or, to color coordinate with the players attire. Likewise, the putter is easily adapted for promotional purposes, and IBM "blue," Caterpillar "yellow," or university color designs, for example, are readily provided. Finally, as indicated above, because the head is molded, the ball striking face of the putter can be adapted to provide a desired ball trajectory, especially over spin, during the putting stroke.

BRIEF SUMMARY OF INVENTION

One of the objects of this invention is to provide an improved golf putter.

Another object of this invention is to provide a golf putter that appears to be constructed completely from elastometric material.

Another object of this invention is to provide a method of constructing a golf club in which the swing weight of the putter is a combined weight of a first mass of one material and a second mass of elastometric material.

Another object of this invention is to provide a golf putter in which the putter head appears to be completely molded from urethane.

Other objects of this invention will be apparent to those skilled in the art in light of the following description and accompanying drawings.

In accordance with this invention, generally stated, a golf putter is provided which may be color coordinated to match a desired mood, but which has excellent feel and ball striking capabilities. Preferably, the head appears to be constructed entirely of elastometric material. The swing weight of the putter head is determined from the combined weight of a mass of the material encapsulate within the elastrometric material and the weight of the elastrometric material encapsulating the mass itself.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
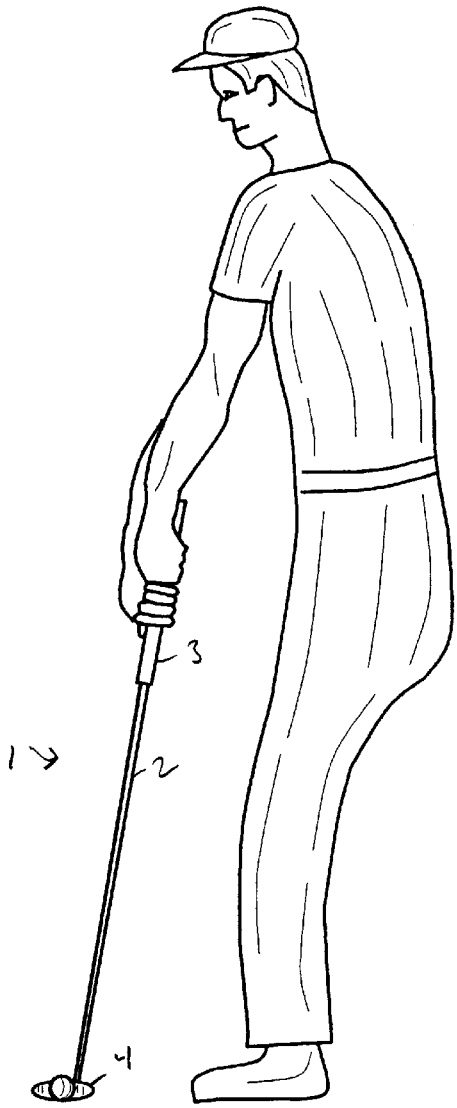
FIG. 1 is a view of one illustrative embodiment of golf putter of the present invention.

Referring now to FIG. 1, reference numeral 1 indicates one illustrative embodiment of golf putter of the present invention. The putter 1 includes a shaft 2 having a grip 3 at one end and a putter head 4 at the other end thereof.

Figure 4:
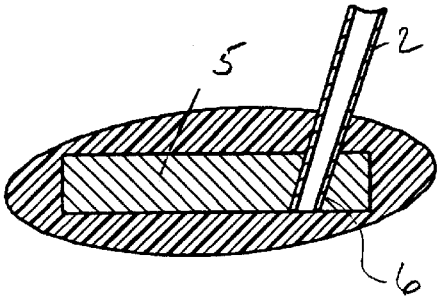
FIG. 4 is a sectional view taken along the lines 4—4 of FIG. 2.
Figure 5:
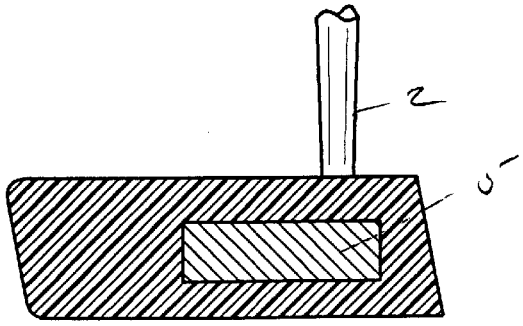
FIG. 5 is a sectional view taken along the line 5—5 of FIG. 2.

The putter head 4 includes a first mass of material 5 of any predetermined shape. As shown in FIG. 4, the mass 5 is, in the embodiment illustrated, generally a body having a rectangular configuration. The mass 5 has an opening 6 formed in it. The opening 6 is designed to receive and hold the shaft to with respect to the mass 5. Attachment of the shaft 2 to the mass 5 may be accomplished by any convenient method. I have found that fiberglass shafts 2, for example, may be attached to a mass 5 of conventional steel, for example, by suitable epoxy adhesives. Other attachment methods are compatible with the broader aspects of this invention.

Figure 2:
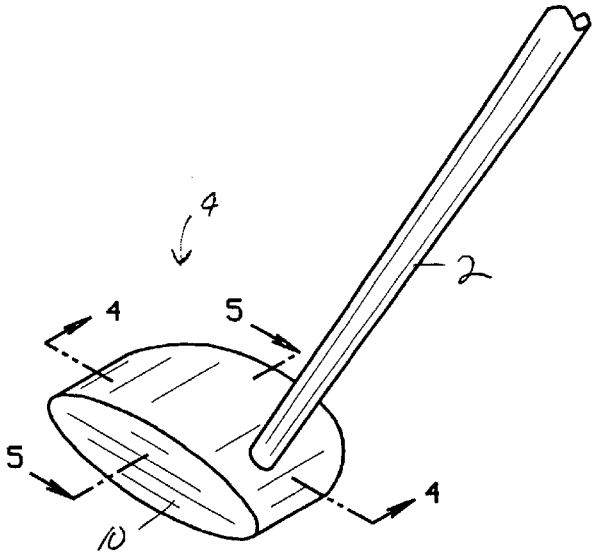
FIG. 2 is a view in perspective of the putter design shown in FIG. 1.

One advantage of the putter 1 of the present invention is that the head 4 gives the appearance of being entirely formed from elastometric material. Preferably, I utilize a urethane material which is mold formed to provide the desired putter head design. As will be appreciated by those skilled in the art, because the putter is urethane, the head design may assume a variety of shapes or configurations, limited only by the imagination of the club head designer. The design of the head 4 shown in FIG. 2 merely is illustrative of any of a variety of designs compatible with broader aspects of the invention.

The head 4 has a ball string face 10, which is formed entirely of urethane. Because the ball striking face 10 is urethane, the putter 1 has substantially better feel than other putter designs. Again, because the face 10 also is molded, the design of the face 10 may be changed simply by altering the mold design. Consequently, the face 10 can be designed to impart a desirable ball rolling or trajectory characteristic to a ball struck with the putter 1.

Figure 3:
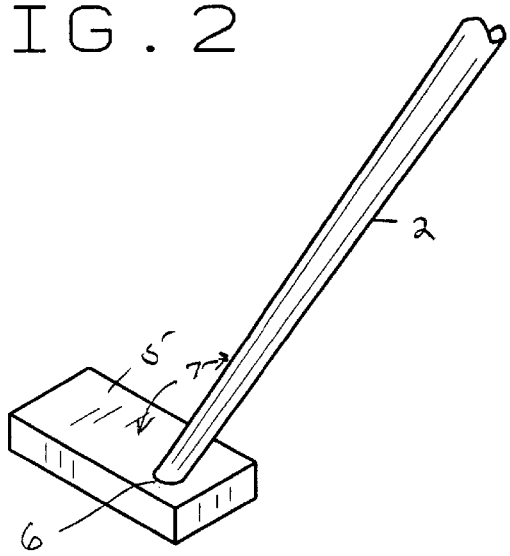
FIG. 3 is a view in perspective of the material mass, which is encapsulated in the putter head of FIG. 2.

In the embodiment illustrated, the mass 5 is a steel material of a predetermined configuration. While a rectangular block of the mass 5 is shown in FIG. 3, those skilled in the art will recognize that other configurations of the mass 5 may be employed with the design. The rectangular mass 5 shown is advantageous in that calculation for different swing weights for the putter I easier to accomplish with a rectangular mass. It is important to note that, as described, the swing weight of the club 1 is made of up two portions, the weight of the mass 5 and the weight of the urethane encapsulating the mass itself. As shown in FIG. 4, the mass 5 is completely encapsulated by the urethane, and the head 4 appears to be, to an observer, constructed entirely of urethane.

In constructing the head 4, the mass 5 is suspended in a suitable mold, not shown, and a metal dowel, not shown, is inserted in the opening 6. Suspension of the mass 5 may be accomplished by using a metal dowel pin inserted through the side of the mold and liquid urethane is then inserted into the mold in a conventional matter. After cure, the metal dowel pin and then the head 4 are removed from the mold. Thereafter, the shaft 2 is inserted into the opening 6 so that the shaft may be aligned with the head 4 in a conventional manner. I have not found the depth of urethane between the ball striking surface 10 and the mass 5 to be critical. I chose the depth to give reasonable life to the ball-striking surface.

Because urethane is employed, it is relatively easy to color the urethane to impart any desired color to the head 4. Thus, the head 4 may match the shaft 2 or have a contrasting color. In addition, the head 4 and the shaft may be color coordinated. That is to say, they may be designed to match a golf bag or wearing apparel, for example of a player.

Numerous variations within the scope of the appended claims will be apparent to those skilled in the art of the foregoing description and accompanying drawings. Merely by way of example, the physical design of the head 4 may vary in other embodiments of the invention. Likewise mass 5 may assume a variety of configurations. While fiberglass shafts were described, those skilled in the art will recognize that shafts of any material may be employed with the putter, if desired. Shaft design may include custom bent shafts, for example. The angle 7 made by this shaft with the mass 5 may vary in other embodiments. The angle is determined by the angle the opening 6 makes with the mass 5 during formation of the opening in the mass 5, may be adjusted merely by the method in which the opening 6 is formed in the mass 5.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is desired to be secured by Letters Patent is:

What is claimed is:

1. A putter comprising:

a weight block sized to give the putter a first swing weight, the weight block having an opening formed in it;

a shaft mounted in the opening of the weight block;

a urethane head completely surrounding the weight block, the urethane of the head having a second swing weight associated with it, the combined swing weight of the urethane and swing weight block being chosen to give the putter a desired swing weight, the head further defining a urethane Mutter face, the urethane head having a design silhouette such that the head appears to be constructed entirely from urethane material, the head design being unrelated to the shape of the weight block.

2. The putter of claim 1 wherein the urethane has a desired color associated with it.

3. The putter of claim 2 wherein the shaft has a color associated with it.

4. The putter of claim 3 wherein the shaft color and the urethane color are different from one another.

5. The putter of claim 1 wherein the weight block is rectangular.

6. The putter of claim 5 wherein the urethane putter face is designed to impart over spin to the ball.

7. A golf putter comprising:

a material mass having a first swing weight;

a shaft attached to the mass;

a urethane head having a second swing weight, the urethane head completely encapsulating the mass to define a putter head, the swing weight of the putter head being determined by the combined swing weight of the mass and swing weight of the urethane, the urethane being formed so as to define a head design silhouette which is independent of the material mass associated with the head, the head further defining a ball striking face.

8. The putter of claim 7 wherein the face is formed to inpart over spin to a ball struck with the putter.

9. The putter of claim 8 wherein the shaft and the urethane each have a pre-selected color associated with them.

10. The putter of claim 9 wherein the color of the shaft and the color of the urethane are different.

11. The putter of claim 10 wherein the shaft material is selected from the group consisting of steel, aluminum and fiberglass.

12. The putter of claim 9 wherein the mass is rectangular.

* * * * *

UNITED STATES PATENT AND TRADEMARK OFFICE

CERTIFICATE OF CORRECTION

PATENT NO. : 6,302,804 B1
DATED : October 16, 2001
INVENTOR(S) : Donald F. Budde It is certified that error appears in the above-identified patent and that said Letters Patent is hereby corrected as shown below:

Column 4,
Line 56, replace "Mutter" with -- putter --

Signed and Sealed this

Third Day of February, 2004

JON W. DUDAS
*Acting Director of the United States Patent and Trademark Office*